US010709204B2

(12) United States Patent
Iuchi et al.

(10) Patent No.: US 10,709,204 B2
(45) Date of Patent: Jul. 14, 2020

(54) SHOES

(71) Applicant: MIZUNO CORPORATION, Osaka-shi, Osaka (JP)

(72) Inventors: Kazunori Iuchi, Osaka (JP); Tetsuo Yamamoto, Osaka (JP); Terumasa Kita, Nara (JP)

(73) Assignee: MIZUNO CORPORATION, Osaka (JP)

( * ) Notice: Subject to any disclaimer, the term of this patent is extended or adjusted under 35 U.S.C. 154(b) by 183 days.

(21) Appl. No.: 14/909,931

(22) PCT Filed: Aug. 7, 2014

(86) PCT No.: PCT/JP2014/070875
§ 371 (c)(1),
(2) Date: Feb. 3, 2016

(87) PCT Pub. No.: WO2015/045639
PCT Pub. Date: Apr. 2, 2015

(65) Prior Publication Data

US 2016/0174660 A1 Jun. 23, 2016

(30) Foreign Application Priority Data

Sep. 30, 2013 (JP) ..... 2013-204626

(51) Int. Cl.
*A43B 13/38* (2006.01)
*A43B 23/00* (2006.01)
(Continued)

(52) U.S. Cl.
CPC ..... *A43B 23/0205* (2013.01); *A43B 1/04* (2013.01); *A43B 23/025* (2013.01);
(Continued)

(58) Field of Classification Search
CPC ... A43B 1/04; A43B 23/0205; A43B 23/0235; A43B 23/0245; A43B 23/0265
(Continued)

(56) References Cited

U.S. PATENT DOCUMENTS 2,102,368 A 12/1937 Martel
2,147,197 A * 2/1939 Glidden ..... A43B 1/02 36/3 A
(Continued)

FOREIGN PATENT DOCUMENTS

JP 6-038608 U 5/1994
JP 2004-105323 4/2004
(Continued)

OTHER PUBLICATIONS

Extended European Search Report issued in corresponding European patent application No. 14847975.1, dated May 17, 2017, 9 pages.

*Primary Examiner* — Jameson D Collier
(74) *Attorney, Agent, or Firm* — Hamre, Schumann, Mueller & Larson, P.C.

(57) ABSTRACT

A shoe (34) of the present invention includes a sole (32) and an upper (33). The upper (33) is composed of a fabric having a knit structure, and contains fiber reinforcement portions (23, 24, and 25) in predetermined portions of the upper (33) integrally. The fiber reinforcement portions (23, 24, and 25) are formed of a float stitch with a plurality of float stitch yarns (19). The shoe of the present invention imparts a proper fit to a wearer's foot by forming the upper composed of the fabric having the knit structure that stretches properly. Also, in the case where the direction of foot force is suddenly changed while the sole contacts the ground, the shoe can hold the foot in desired predetermined positions by the fiber reinforcement portions situated in predetermined positions of the upper integrally. Thus, the present invention
(Continued)

provides a shoe having proper holding properties while maintaining fitting properties.

5 Claims, 12 Drawing Sheets

(51) Int. Cl.
*A43B 1/02* (2006.01)
*A43B 1/10* (2006.01)
*A43B 23/02* (2006.01)
*A43B 1/04* (2006.01)

(52) U.S. Cl.
CPC ..... *A43B 23/0235* (2013.01); *A43B 23/0245* (2013.01); *A43B 23/0265* (2013.01)

(58) Field of Classification Search
USPC ..... 36/45, 9 R, 84; 12/142 C
See application file for complete search history.

(56) References Cited

U.S. PATENT DOCUMENTS 2,586,045 A * 2/1952 Hoza ..... A43B 1/04 36/14
4,109,492 A 8/1978 Roberts
4,317,292 A * 3/1982 Melton ..... A41B 11/007 12/142 G
5,996,189 A 12/1999 Wang
6,286,151 B1 * 9/2001 Lambertz ..... A41B 11/003 2/239
6,931,762 B1 * 8/2005 Dua ..... A43B 1/04 12/142 G
7,192,411 B2 * 3/2007 Gobet ..... A61F 13/08 2/239
7,677,061 B2 * 3/2010 Mori ..... A41B 11/02 66/185
7,721,575 B2 * 5/2010 Yokoyama ..... A41B 11/004 66/185
D624,300 S * 9/2010 Hollingsworth ..... D2/980
7,971,280 B2 * 7/2011 Kaneda ..... A41B 11/02 2/239
7,996,924 B2 * 8/2011 Wright ..... A41D 13/0015 2/239
2003/0230121 A1 12/2003 Yokoyama
2005/0076536 A1 4/2005 Hatfield et al.
2005/0262739 A1 12/2005 McDonald et al.
2005/0268491 A1 12/2005 McDonald et al.
2006/0059721 A1 3/2006 Hatfield et al.
2006/0061012 A1 3/2006 Hatfield et al.
2006/0162190 A1 7/2006 Nishiwaki et al.
2006/0283042 A1 12/2006 Greene et al.
2007/0094896 A1 5/2007 Hatfield et al.
2007/0180730 A1 8/2007 Greene et al.
2008/0022553 A1 1/2008 McDonald et al.
2009/0126081 A1 * 5/2009 Lambertz ..... A41B 11/003 2/239
2009/0126230 A1 5/2009 McDonald et al.
2009/0165190 A1 * 7/2009 Araki ..... A61F 13/064 2/240
2009/0223004 A1 9/2009 Greene et al.
2009/0241374 A1 10/2009 Sato et al.
2009/0293314 A1 12/2009 Dekovic et al.
2010/0154256 A1 6/2010 Dua
2011/0041362 A1 2/2011 Nishiwaki et al.
2011/0107501 A1 * 5/2011 Kawahara ..... A41B 11/02 2/239
2012/0030965 A1 2/2012 Greene et al.
2012/0102625 A1 * 5/2012 Klein ..... A41B 11/003 2/239
2012/0159815 A1 6/2012 Dekovic et al.
2012/0180195 A1 7/2012 Shull
2012/0216423 A1 * 8/2012 Lyden ..... A43B 1/0081 36/84
2012/0233882 A1 9/2012 Huffa et al.
2012/0318026 A1 12/2012 Dua et al.
2013/0000159 A1 1/2013 Hatfield et al.
2013/0025157 A1 6/2013 Wan et al.
2013/0145652 A1 6/2013 Podhajny et al.
2013/0239438 A1 * 9/2013 Dua ..... A43B 1/04 36/84
2013/0298425 A1 11/2013 McDonald et al.
2013/0318837 A1 12/2013 Dua et al.
2014/0068968 A1 3/2014 Podhajny et al.
2014/0230277 A1 8/2014 Dua et al.
2014/0237855 A1 8/2014 Podhajny et al.
2014/0238081 A1 * 8/2014 Meir ..... D04B 1/22 66/64
2014/0238083 A1 * 8/2014 Meir ..... D04B 15/90 66/64
2014/0245639 A1 9/2014 Dua et al.
2014/0245643 A1 9/2014 Huffa et al.
2014/0373288 A1 12/2014 Greene et al.
2015/0000164 A1 1/2015 Dekovic et al.
2015/0068065 A1 3/2015 McDonald et al.
2015/0143641 A1 5/2015 Hatfield et al.
2015/0208753 A1 7/2015 Dua et al.
2015/0216255 A1 * 8/2015 Podhajny ..... A43B 23/024 12/142 G

FOREIGN PATENT DOCUMENTS

JP 2010-031437 2/2010
JP 2010-042270 2/2010
JP 4447559 B 4/2010
JP 4620677 B 1/2011
JP 4918571 B 4/2012
JP 2012-512698 6/2012
JP 5026712 B 9/2012
JP 2015066280 A * 4/2015 ..... A43B 1/04
WO 2009/122821 10/2009
WO 2012/125473 9/2012
WO 2012/166244 12/2012

* cited by examiner

SHOES

TECHNICAL FIELD

The present invention relates to a shoe, and more preferably a shoe including a sole and an upper.

BACKGROUND ART

Conventionally, shoes composed of a mesh-like material, including an upper formed of a matrix layer having a stretchability due to a mesh-like structure have been known (Patent Document 1 below). A shoe upper of Patent Document 1 provides a wearer with a comfortable fit (fit feeling) by having the stretchability so as not to restrict the movement of a foot during exercise.

PRIOR ART DOCUMENT

Patent Document

Patent Document 1: JP 2010-42270 A

DISCLOSURE OF INVENTION

Problems to be Solved by the Invention

In general, it is considered that a shoe upper can suppress a slippage between a shoe and a foot by holding the foot when the direction of a foot force is suddenly changed while a sole contacts the ground, for example when a user stops the movement of the foot. However, since the shoe of Patent Document 1 includes an upper formed of a stretchable matrix layer so as not to restrict the movement of the foot, it is thought that the slippage between the shoe and the foot cannot be prevented sufficiently when the direction of the foot force is suddenly changed while the sole contacts the ground. Accordingly, the shoe of Patent Document 1 seems to have a problem of insufficient ability to hold the foot as a result of the slippage between the shoes and the foot.

In order to solve the above-mentioned conventional problem, the present invention provides a shoe having proper holding properties while maintaining fitting properties.

Means for Solving Problem

A shoe of the present invention includes a sole and an upper. The upper is composed of a fabric having a knit structure, and includes at least one fiber reinforcement portion in a predetermined position of the upper integrally. The fiber reinforcement portion is formed of a float stitch with a plurality of float stitch yarns.

Effects of the Invention

The shoe of the present invention imparts a proper fit to the wearer's foot by forming an upper composed of a fabric having a knit structure, because the upper composed of the fabric having the knit structure stretches properly. Also, in the case where the direction of foot force is suddenly changed while the sole contacts the ground, the shoe can hold a desired predetermined position of the foot by the fiber reinforcement portion situated in a predetermined position of the upper integrally. Moreover, by having the fiber reinforcement portion formed of the float stitch with a plurality of float stitch yarns, when the fabric having the knit structure is appropriately stretched, the tension of the float stitch yarns of the float stitch can be raised and as a result the shoe can hold the foot tightly. Unlike the fiber reinforcement portion made of materials such as a resin or a rubber, the fiber reinforcement portion formed of the float stitch allows the upper to have the proper holding properties. By doing so, the present invention can provides the shoe having the proper holding properties while maintaining the fitting properties. In addition, the manufacturing cost will be lower by introducing the upper composed of the knit structure, and the fiber reinforcement portion formed of the float stitch.

DESCRIPTION OF THE INVENTION

The present inventors arrived at an idea of producing a shoe by attaching a sole to an upper composed of a knit structure. However, since the upper composed of the knit structure has fitting properties but is poor in holding properties, it is difficult to use such a shoe as it is for sports. Then, the present inventors conceived the idea of integrally forming fiber reinforcement portion in a predetermined (specific) position of the upper composed of the knit structure. From such an idea, the present inventors conducted numerous studies and as a result the shoe of the present invention, especially suitable for use in sports, is accomplished.

The present invention relates to a shoe including a sole and an upper. Although any sole for use in shoes may be used, it is preferable to use soles for use in sports shoes having cushioning properties and repulsion. An inner sole may be contained in the inside of the upper.

Figure 1A:
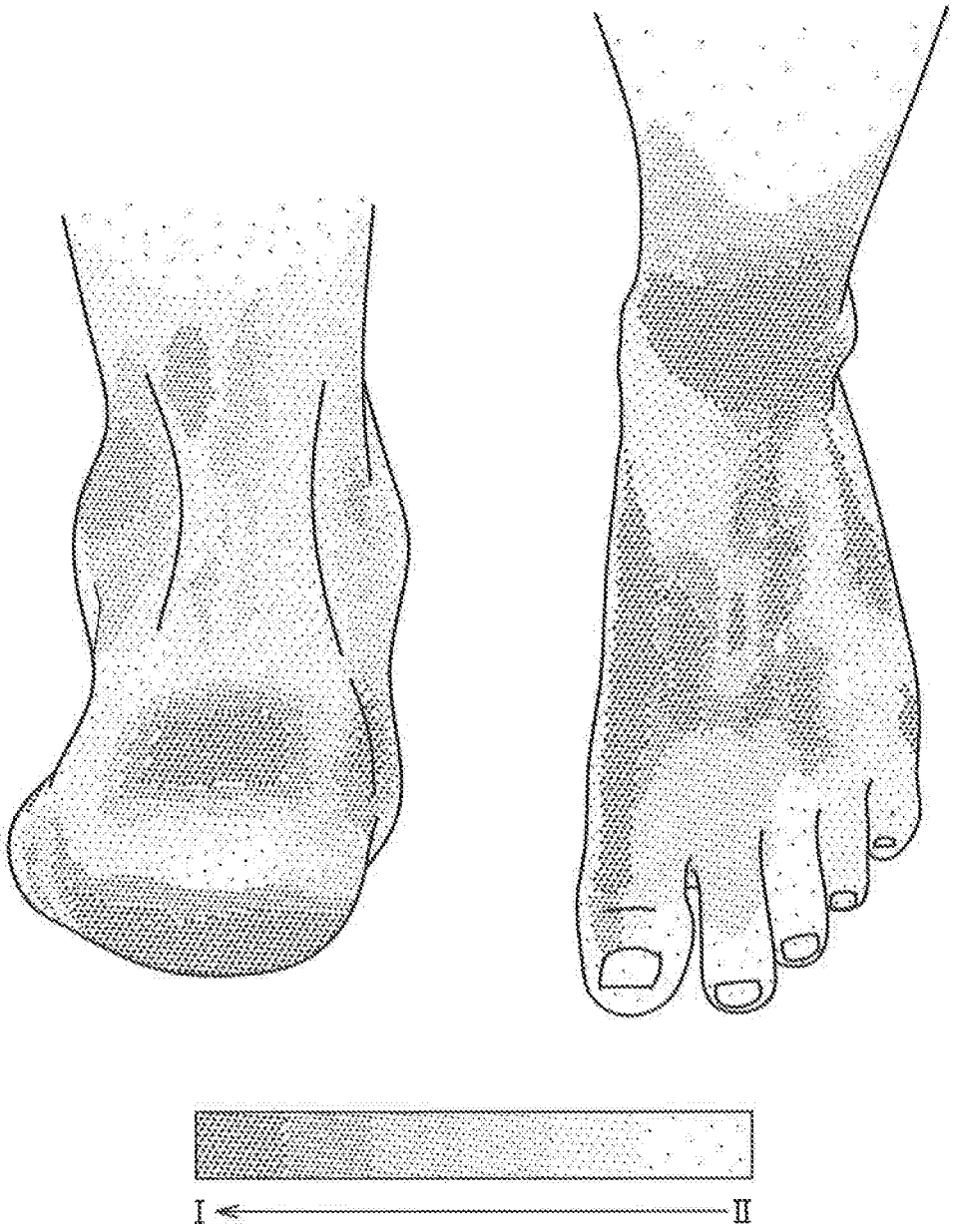
FIG. 1A is a front view and a back view of a foot illustrating a distribution of extension of the skin of a foot during running.
Figure 1B:
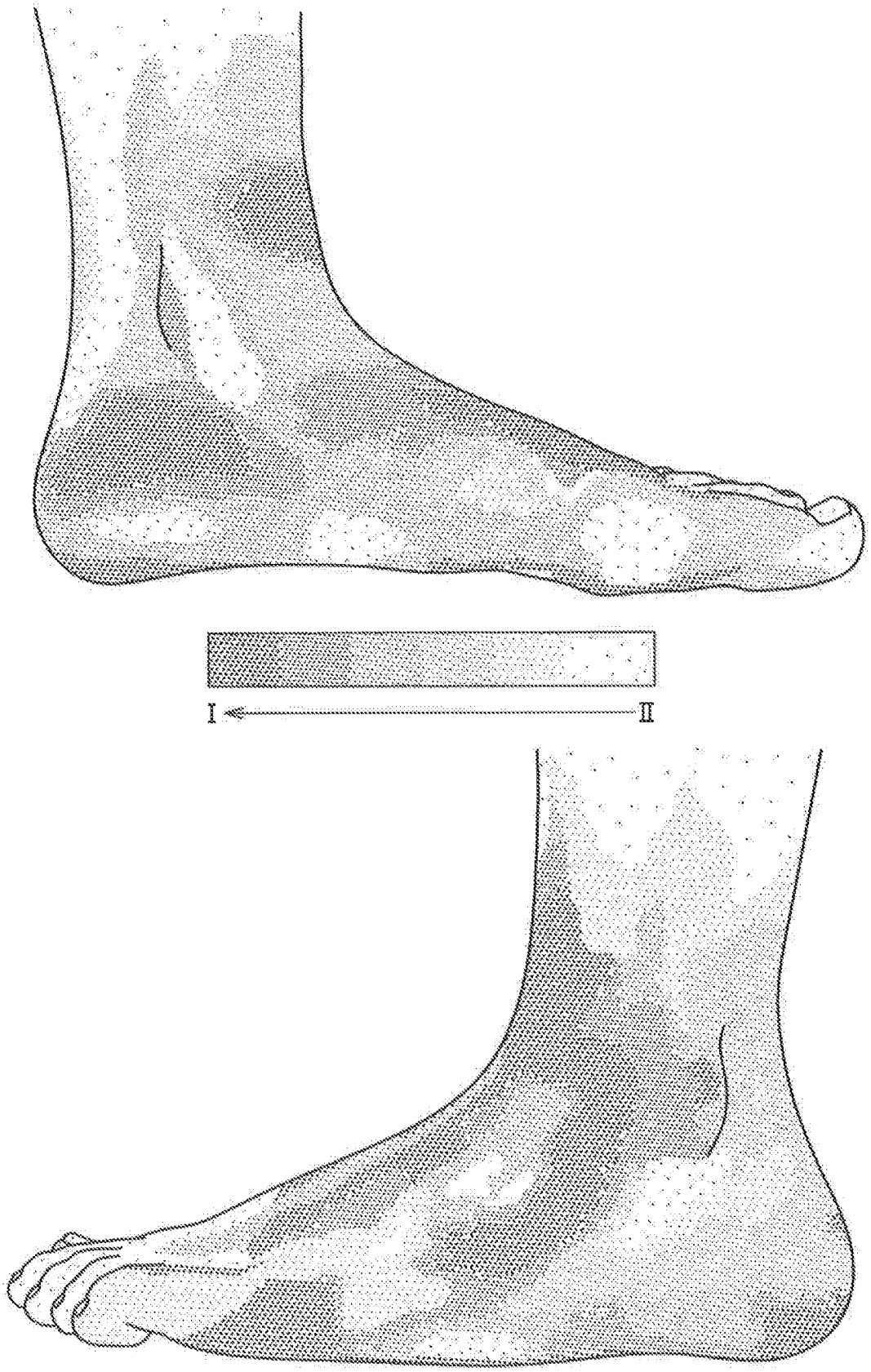
FIG. 1B is a right side view and a left side view of a foot illustrating a distribution of extension of the skin of a foot during running.
Figure 2A:
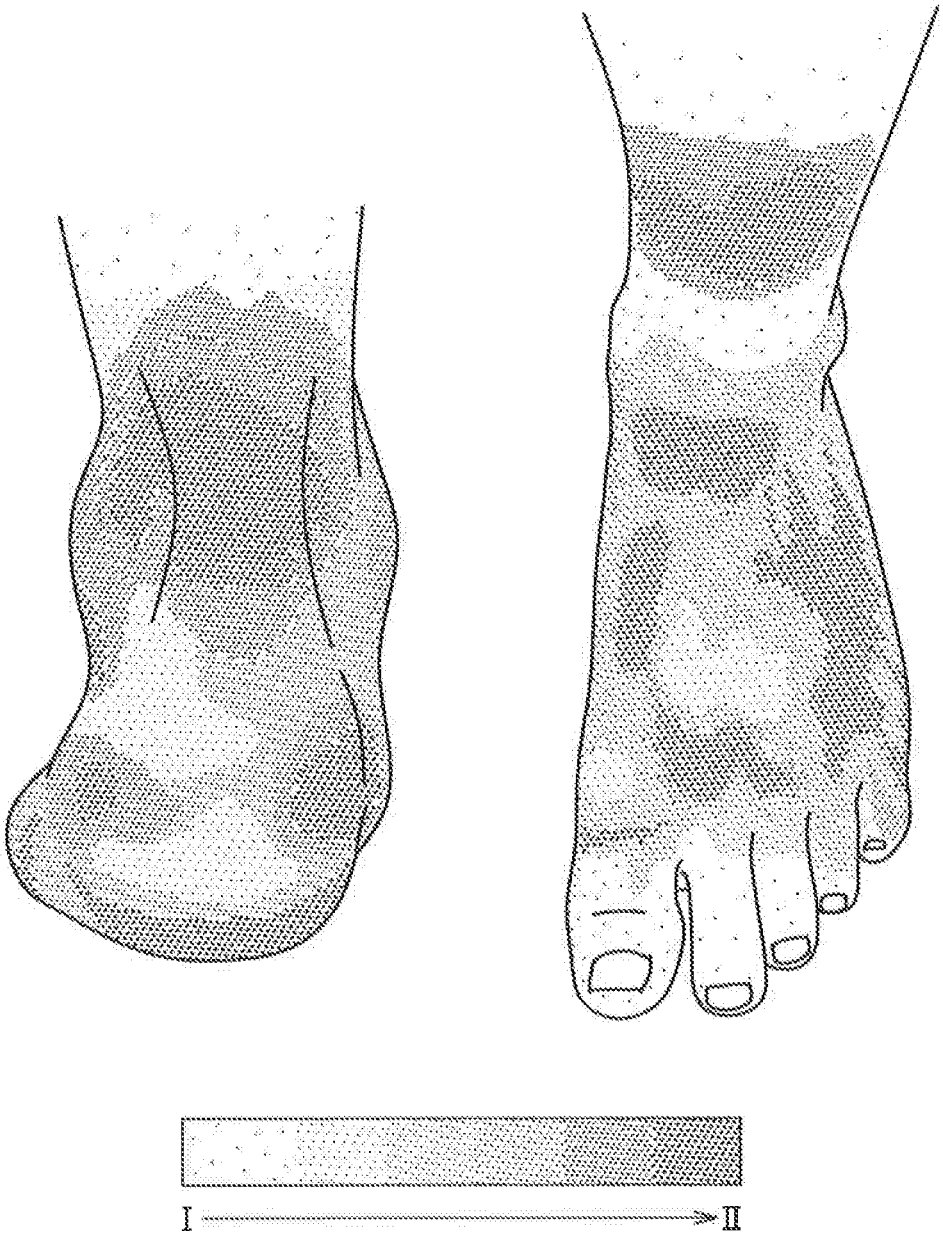
FIG. 2A is a front view and a back view of a foot illustrating a distribution of contraction of the skin of a foot during running.
Figure 2B:
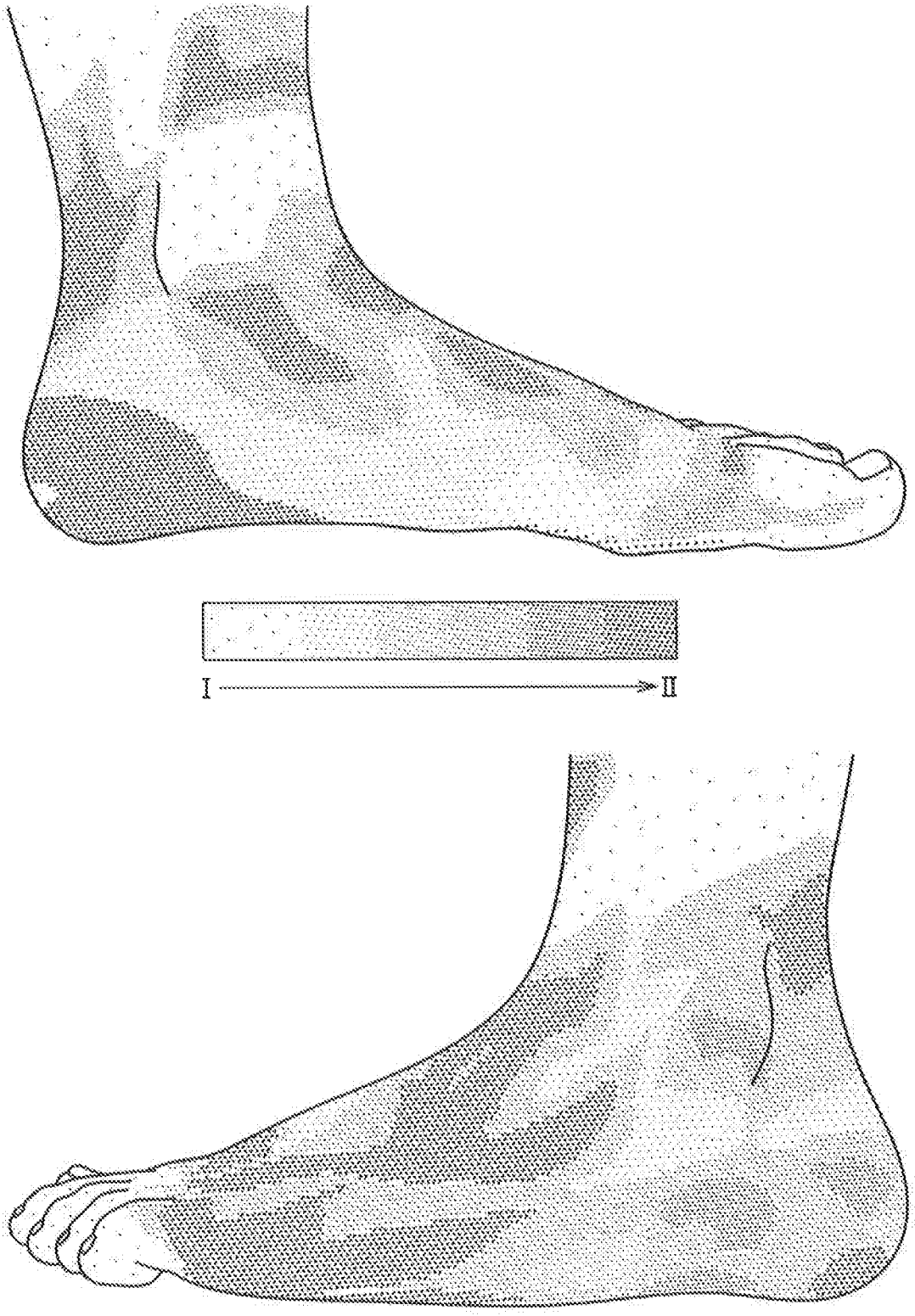
FIG. 2B is a right side view and a left side view of a foot illustrating a distribution of contraction of the skin of a foot during running.

To begin with, the present inventors examined a suitable position for the fiber reinforcement portion by analyzing the extension and contraction of the skin during running for example, in order to produce the shoe of the present invention. FIGS. 1A and 1B are a front view, a back view and a view of both sides showing the distribution of extension of the skin of the foot during running, wherein a darker colored dot represents a larger extension. FIGS. 2A and 2B are a front view, a back view and a view of both sides showing the distribution of contraction of the skin of the foot during running, wherein a darker colored dot represents a larger contraction. From the analysis, it is found that the fiber reinforcement portion of the upper is preferably included in the following positions A to C as an example.

A: A position to hold cuneiform bones, a cuboid bone and a navicular bone

Figure 3A:
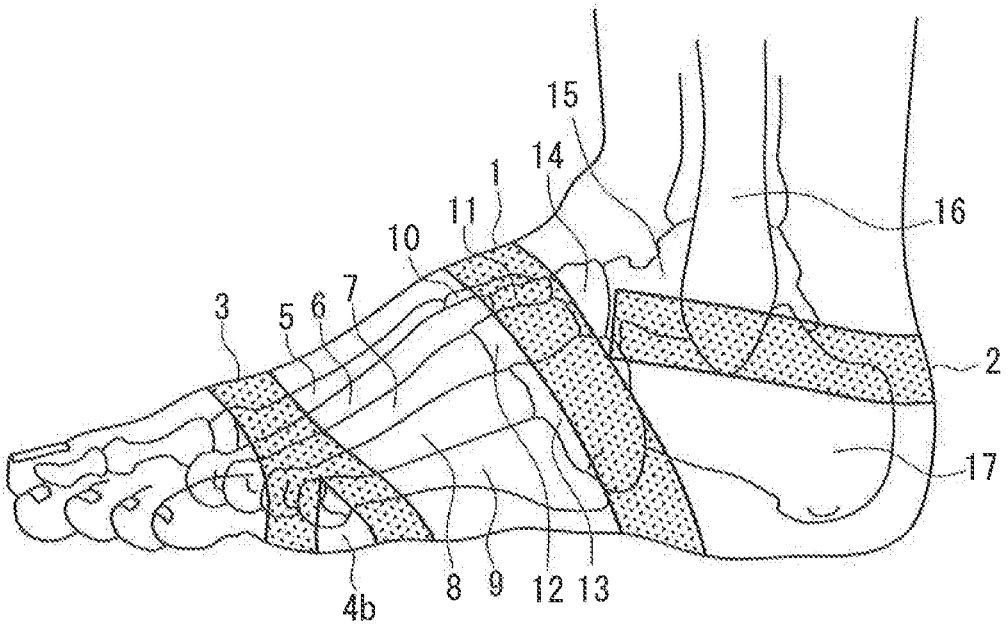
FIG. 3A is a schematic perspective view illustrating a skeleton of a human foot and a fiber reinforcement portion in one embodiment of the present invention.
Figure 3B:
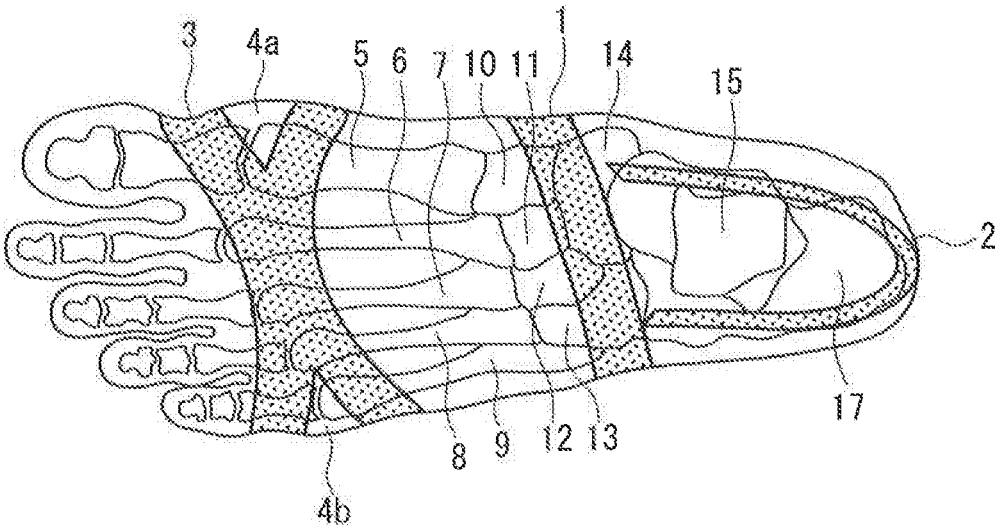
FIG. 3B is a plan view of the same.

B: A position to hold a lower part of a lateral malleolus, a lower part of a medial malleolus and an upper part of a calcaneal bone C: A position to hold at least one part of each of a first metatarsal bone to a fifth metatarsal bone FIGS. 3A to B show the positions A to C, which were a fiber reinforcement portion (A) 1, a fiber reinforcement portion (B) 2, and a fiber reinforcement portion (C) 3. The fiber reinforcement portion (A) 1 is provided in a position to hold an inner cuneiform bone 10, a middle cuneiform bone 11, an outer cuneiform bone 12, a cuboid bone 13 and a navicular bone 14. The fiber reinforcement portion (B) 2 is provided in a position to hold the lower part of a lateral malleolus, the lower part of a medial malleolus and the upper part of a calcaneus 17. The fiber reinforcement portion (C) 3 is provided in a position to hold at least one part of each of a first metatarsal bone 5, a second metatarsal bone 6, a third metatarsal bone 7, a fourth metatarsal bone 8, and a fifth metatarsal bone 9. 15 is a talus, and 16 is a fibula. The fiber reinforcement portion (C) 3 is preferably disposed in a position to avoid an area covering a head part 4*a* of the first metatarsal bone and a head part 4*b* of the fifth metatarsal bone. Because some people feel pain when the head parts of the first metatarsal bone and the fifth metatarsal bone are pressed. The fiber reinforcement portions (A) and (B) may be partially connected.

Figure 4:
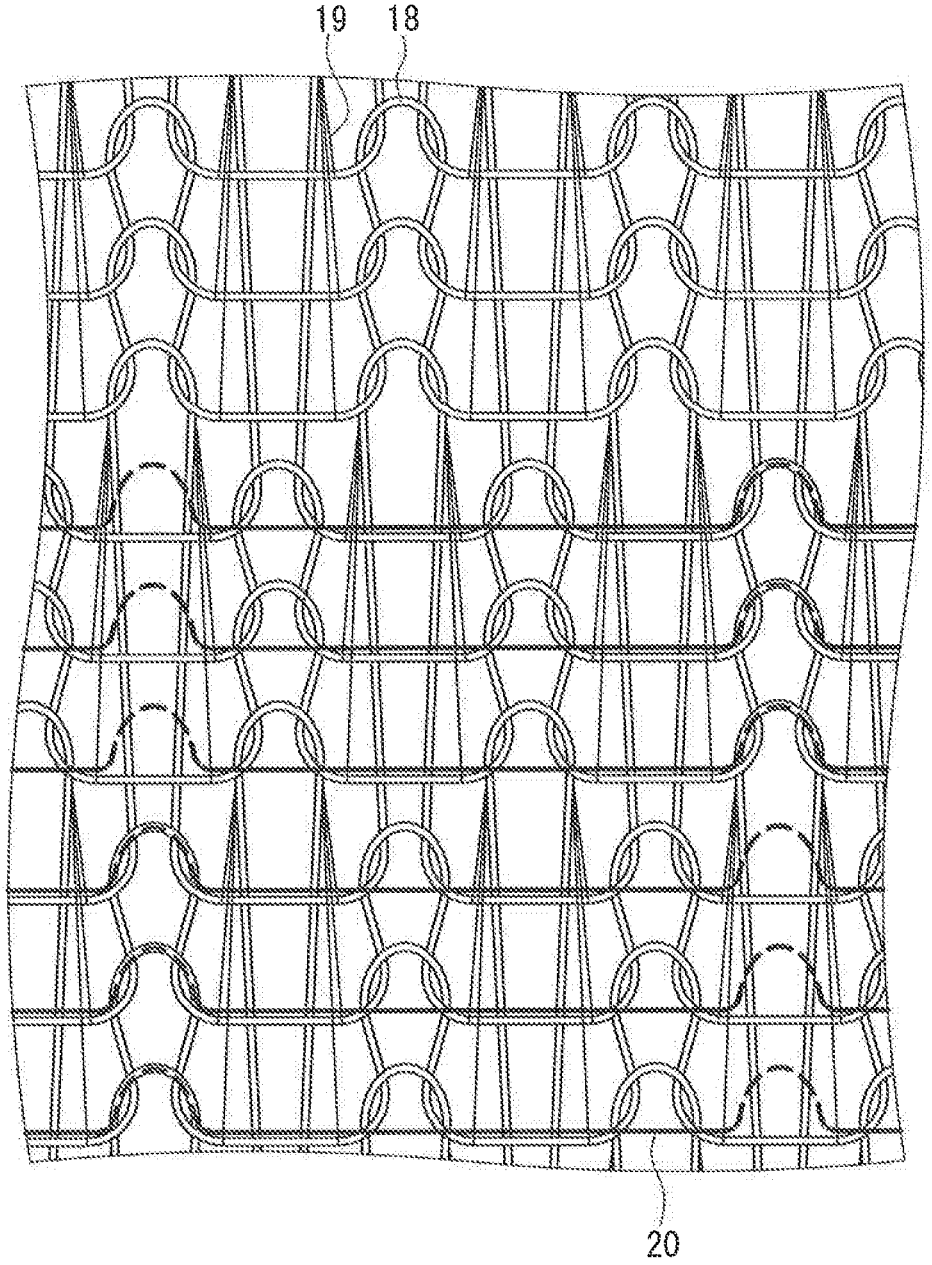
FIG. 4 is a schematic knitting diagram illustrating a float stitch structure used for the fiber reinforcement portion in one embodiment of the present invention.

The shoe upper of the present invention is composed of the fabric having a knit structure, in which fiber reinforcement portions 1 to 3 are situated in predetermined positions of the upper integrally, and the fiber reinforcement portions 1 to 3 are formed of a float stitch (also called as a welt knitting) with a plurality of float stitch yarns. In the case of circular knitting for example, this knit structure can be achieved by a float stitch structure. In the fiber reinforcement portions 1 to 3, the float stitch yarns are preferably arranged on the inner side of the shoe. The float stitch can be formed integrally with a base knitted fabric having the knit structure, and has excellent shape stability and durability. The base knitted fabric may be formed of any one of a tuck stitch, a back tuck stitch or a jersey stitch, or a combination of these. The float stitch yarns are arranged on the inner side of the shoe for the sake of improving appearance in design and ensuring safety. An example of the float stitch is shown in FIG. 4. In FIG. 4, a face yarn 18 and a back yarn 19 create a stitch in every loop as in normal knitting, whereas a float stitch yarn 20 skips (floats) 1 to 10 loops to create a stitch.

Figure 5:
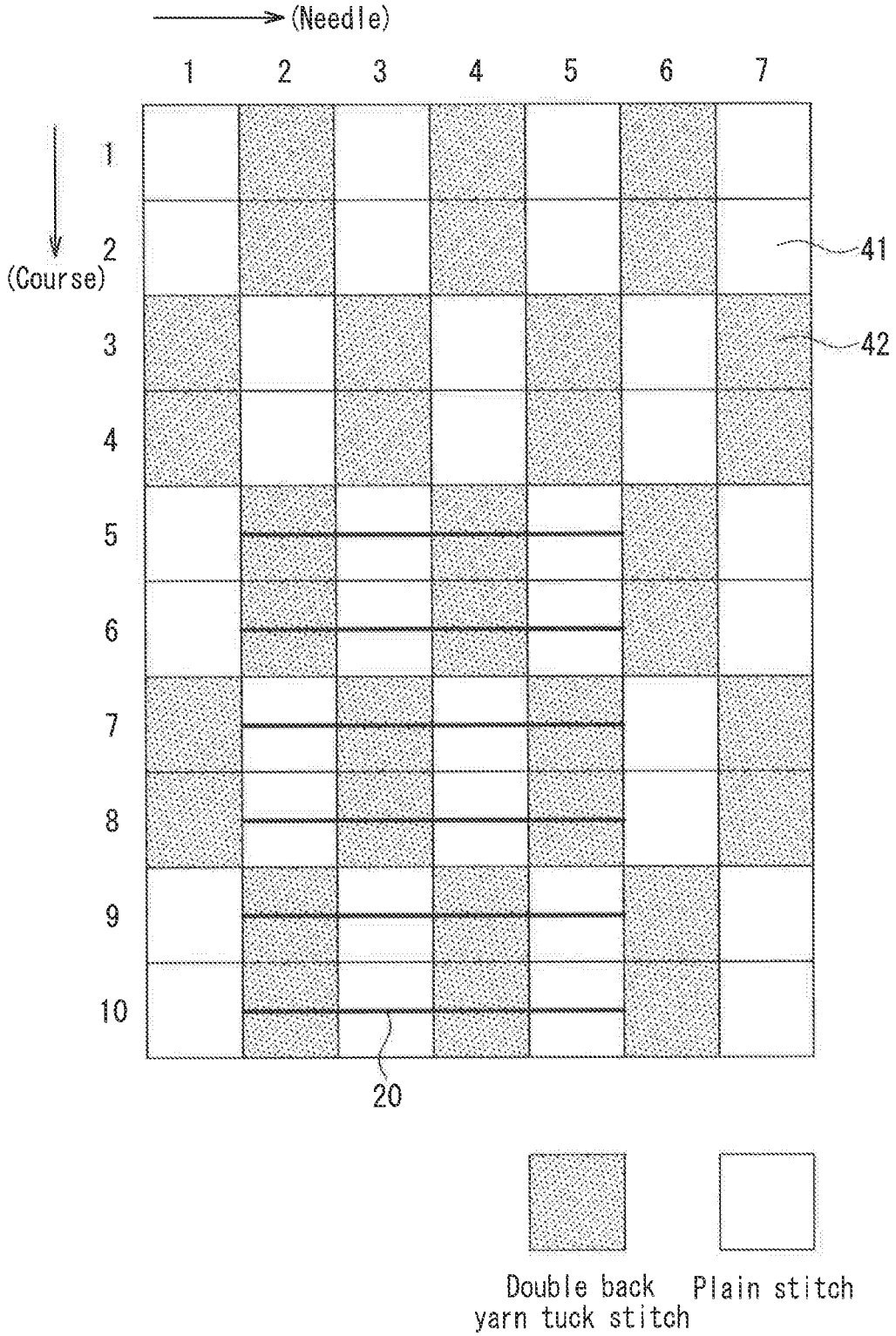
FIG. 5 is a structure chart illustrating the float stitch structure used for the fiber reinforcement portion in one embodiment of the present invention.

FIG. 5 is a structure chart illustrating a float stitch structure used in the fiber reinforcement portion in one embodiment of the present invention. In this knit fabric, courses 1 to 4 include a knit fabric having a ground weave formed by a plain stitch 41 and a double back yarn tuck stitch 42, and courses 5 to 10 include a float stitch fabric in which the float stitch yarn 20 floats over two loops of the plain stitch 41 and the double back yarn tuck stitch 42.

It is preferable that a stress in a portion of the float stitch is 1.2 times or more greater than a stress in a portion of a base knit when a strain ratio (stretch ratio) of the portion of the float stitch in a float stitch yarn direction is 1 (two times the length before measurement). A more preferable ratio of stress in the portion of the float stitch to that in the portion of the base knit is 1.5 times or more. The portion of the float stitch having the above-mentioned ranges has a sufficient reinforcement effect and thus a deformation of the shoe can be prevented when forces from different directions are applied to the foot, and can secure the safety of the foot.

It is preferable that the fiber yarn used for the fabric having the knit structure is a fiber yarn including an elastic yarn. The elastic yarn is preferably at least one selected from a polyurethane-based elastic yarn and a polyester-based elastic yarn, because they are highly stretchable and suitable for the upper to fit in with the foot. The elastic yarn may be used as a bare yarn arranged in parallel with a non-elastic yarn (rigid yarn), or may be used as a covered yarn with its surface covered with a polyester fiber, a nylon fiber, an acrylic fiber, wool, cotton etc.

Figure 8:
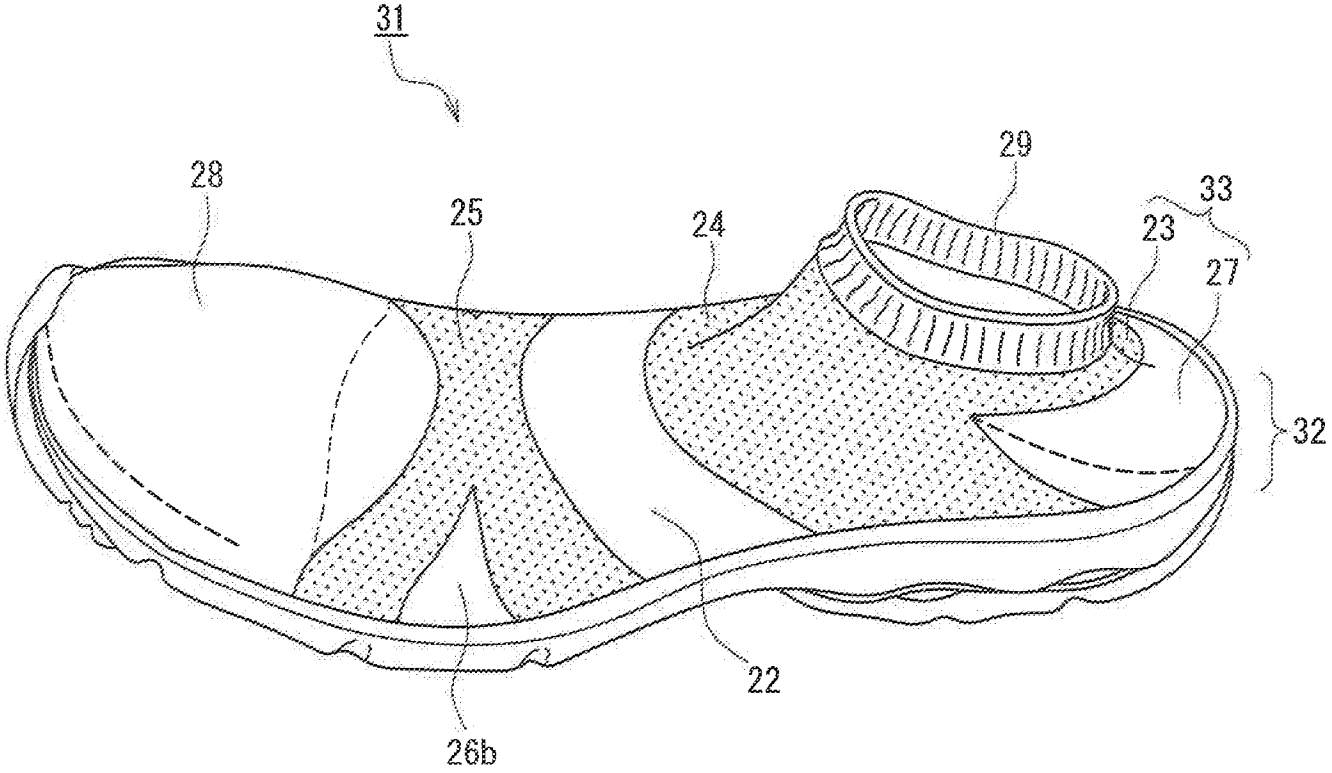
FIG. 8 is an external perspective view illustrating a shoe in one embodiment of the present invention.

The fabric having the knit structure can be knitted by using circular knitting machines manufactured by LONATI™ S.p.A, for example. Among these, a circular knitting machine having a diameter of 3.75 inch, and 132 or 144 needles is particularly suitable for the present invention The shoe in one embodiment of the present invention includes a substantially sock-shaped upper composed of the fabric having the knit structure as shown in FIG. 8. The shoe can be produced by fixing the bottom of the sock-shaped upper to the sole without changing its sock shape. In this way, the shoe having the sock-shaped upper can be produced, and the shoe has fitting properties, the holding properties and a simple design.

Figure 9:
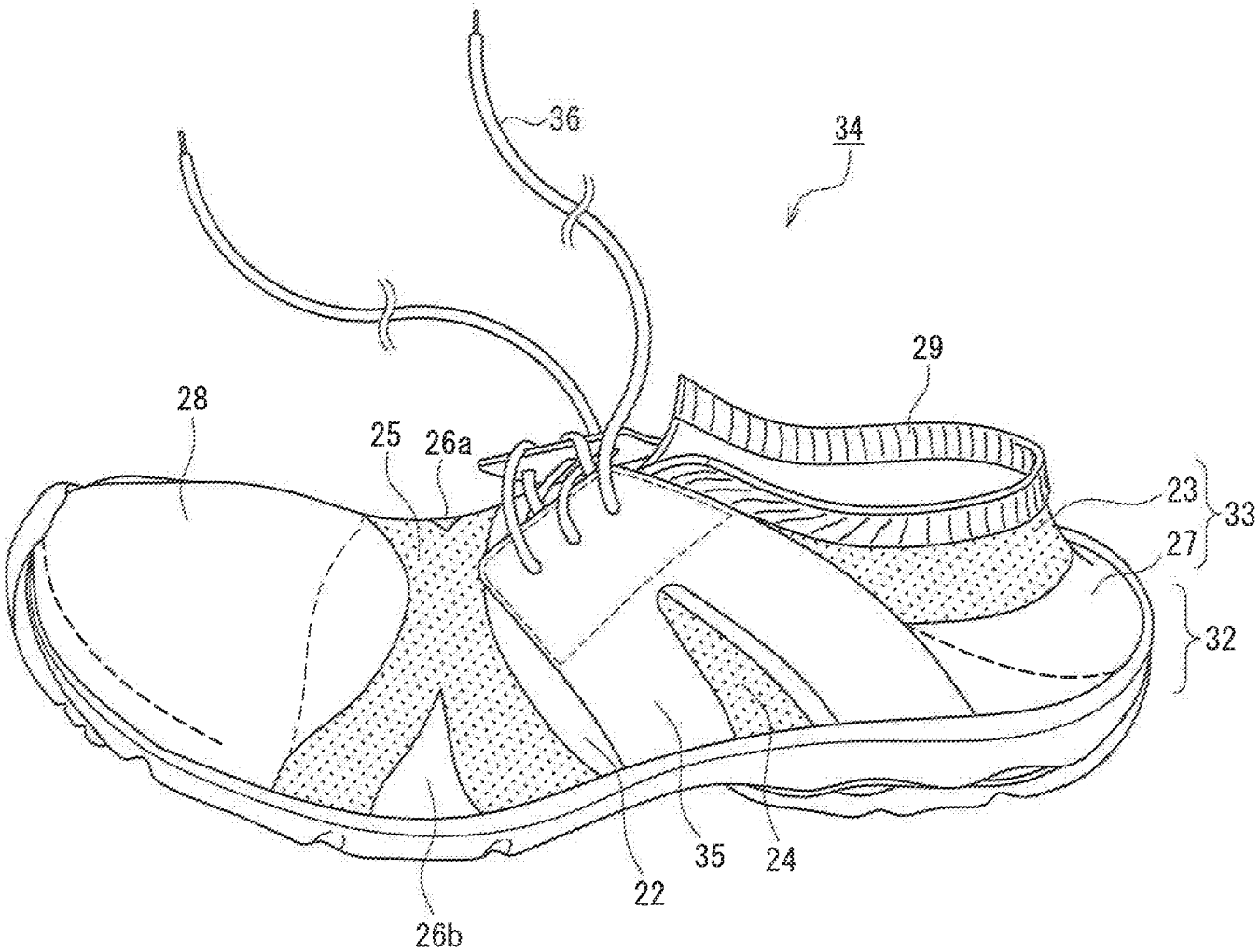
FIG. 9 is an external perspective view illustrating a shoe in another embodiment of the present invention.

The shoe in another embodiment of the present invention includes a substantially sock-shaped upper composed of the fabric having the knit structure as shown in FIG. 9. The shoe is produced by fixing the bottom of the upper to the sole, partially cutting the front part of the ankle, disposing a reinforcement sheet on the side, and providing a shoelace portion. This type of shoe is capable of fixing the foot more tightly by the side reinforcement portions and the shoelace.

The shoe of the present invention is suitable as various sport shoes such as marathon shoes, running shoes, walking shoes, and as ordinary shoes such as town shoes.

Figure 6:
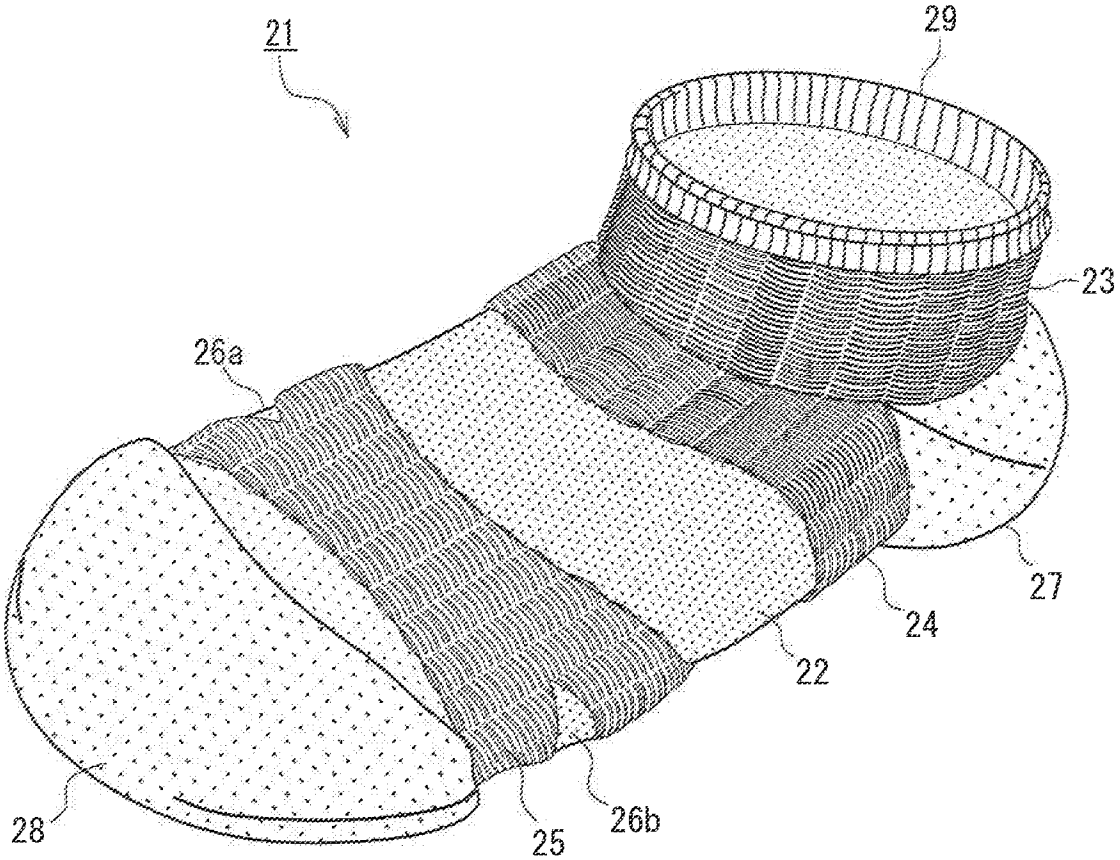
FIG. 6 is an external perspective view illustrating a sock-shaped upper in one embodiment of the present invention.

Hereinafter, the shoe of the present invention will be described on the basis of drawings. In the following drawings, the same reference numerals denote the same components. FIG. 6 is an external perspective view illustrating a sock-shaped upper used in one embodiment of the present invention. This sock-shaped upper 21 is formed using a circular knitting machine, and a base knit portion 22, a calcaneus portion 27 and a tiptoe portion 28 are formed of an ordinal knit structure. Fiber reinforcement portions 23, 24 and 25 are formed of the float stitch structure.

The fiber reinforcement portion 23 is provided in a position corresponding to one part of each of cuneiform bones, a cuboid bone and a navicular bone of the user when the shoe of this embodiment is worn by the user. The fiber reinforcement portion 24 is provided in a position corresponding to the lower part of the lateral malleolus, the lower part of the medial malleolus, and the upper part of the calcaneus. These fiber reinforcement portions 23 and 24 correspond to a part of the user's footwhere the degree of extension and contraction of the skin of the foot is smaller than any other parts thereof when the user takes exercise. Therefore, it is possible to prevent the impairment of foot comfort when the foot is held by the fiber reinforcement portions 23 and 24, since there is a small change in a friction force or a pressure caused by the extension and contraction of the skin. The fiber reinforcement portion 25 is provided in a position corresponding to at least one part of each of the first metatarsal bone to the fifth metatarsal bone on the tiptoe side so as to cover the first metatarsal bone, the second metatarsal bone, the third metatarsal bone, the fourth metatarsal bone, and the fifth metatarsal bone. The fiber reinforcement portion 25 is particularly capable of holding the tiptoe side of the foot sufficiently even when the direction of foot force is changed suddenly to a width direction (foot width direction) of the foot. The fiber reinforcement portion 25 has a first gap 26*a* configured to avoid the area covering a head part of the first metatarsal bone and a second gap 26*b* configured to avoid the area covering a head part of the fifth metatarsal bone.

An opening 29 of the sock-shaped upper 21 is reinforced by folding the fabric back inwardly. The upper 21 is formed 40-90% smaller than that at the time of being assembled into the shoe so as to be stretched and integrated into the shoe at the time of assembly. By forming the shoe in this way, it is possible to enhance the fitting properties of the upper 21. When the length of the upper 21 in the stationary state is defined as 1, it is preferred that the upper 21 after being assembled into the shoe stretches in a range from 1.1 to 2.5 times.

Figure 7:
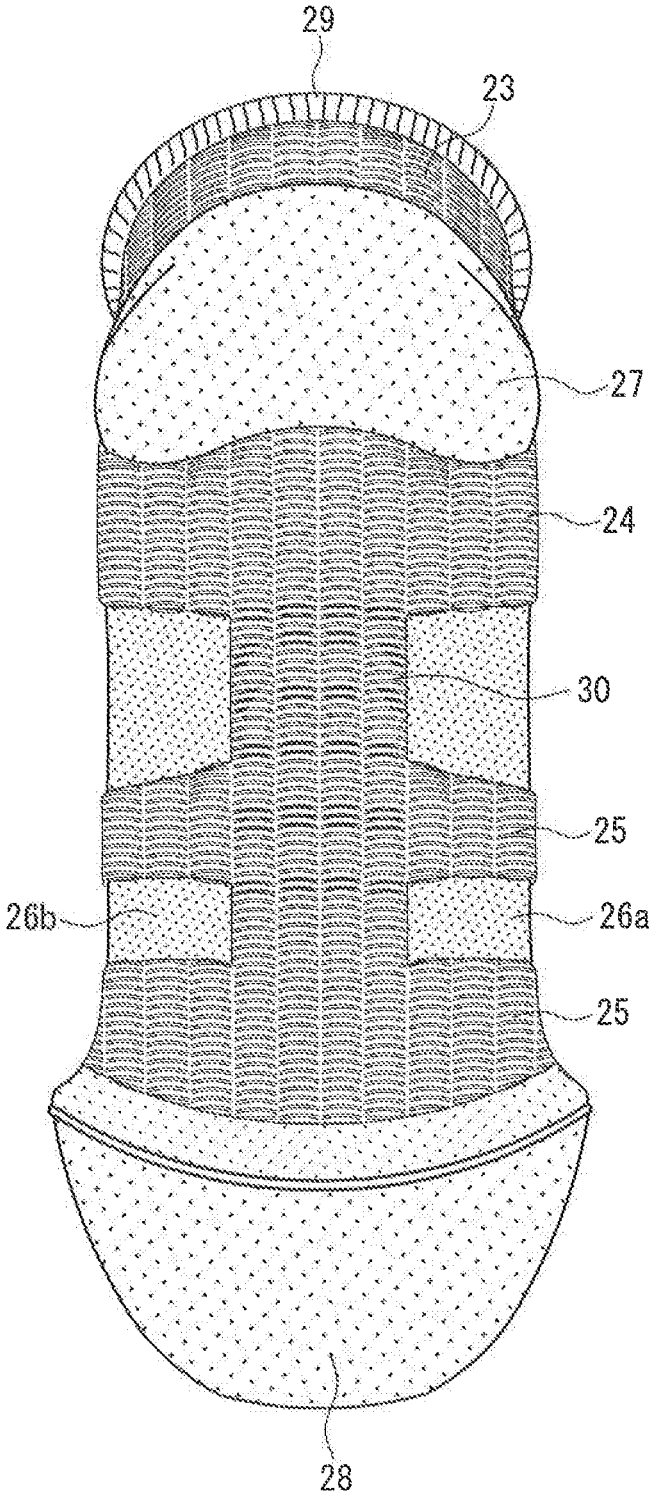
FIG. 7 is a bottom view illustrating a sock-shaped upper in one embodiment of the present invention viewed from the bottom.

FIG. 7 is a bottom view of the upper 21 viewed from the bottom. The fiber reinforcement portions 24 and 25 are connected via a reinforcement portion 30 in the bottom. The fiber reinforcement portion 30 is formed extending from the part corresponding to the underside of the calcaneal bone, to the part corresponding to the tiptoe side of the second metatarsal bone to the fourth metatarsal bone. This configuration allows easy adhesion of the upper when the bottom part of the upper is adhesively integrated with the sole, and does not impair the cushioning properties.

FIG. 8 is an external perspective view illustrating a shoe 31 in one embodiment of the present invention. The shoe 31 is obtained by stretching the sock-shaped upper 21 shown in FIG. 7 to about two times in size to prepare an upper material 33, and then integrating the upper material 33 with a sole 32 by an adhesive. The shoe 31 has the fitting properties, the holding properties and a simple design. In the description, the substantially sock-shaped upper 21 is used for the shoe 31 in one embodiment of the present invention above. However, a non-sock shaped upper being divided in the foot width direction in a part corresponding to the fiber reinforcement portion 30, or a non-sock shaped upper having an opening in a part corresponding to the sole of the foot may be used.

FIG. 9 is an external perspective view illustrating a shoe 34 in another embodiment of the present invention. The shoe of FIG. 9 differs from that of FIG. 8 in that the shoe of FIG. 9 is produced by cutting a front ankle part of the sock partially and disposing a reinforcement sheet 35 on the side, providing a shoelace portion, and passing a shoelace 36 therein. This type of shoe 34 can hold the foot more tightly with the reinforcement sheet 35 and the shoelace 36.

EXAMPLE

Next, the present invention is further specifically described by way of an example. It should be noted that the present invention is not limited to the example.

Example 1

(1) Yarn Used

The following yarns were used in the reinforcement portion shown in FIG. 6 face yarn: the following a back yarn: the following b and the following rubber yarn knit structure: back tuck stitch+float stitch The following yarns were used in the non-reinforced knit portion face yarn: the following a back yarn: the following b and the following rubber yarn knit structure: back tuck stitch a: polyester (PET) multifilament yarn having a fineness of 111 decitex (100 d)–48 filaments/2×3.

b: single covered yarn in which polyurethane yarn having a fineness of 33 decitex (30 d) is single covered with polyester (PET) yarn having a fineness of 83 decitex (75 d)

rubber yarn: double covered yarn in which polyurethane yarn having a fineness of 289 decitex (260 d) is double covered with polyester (PET) yarn having a fineness of 83 decitex (75 d)

(2) Knitting Machine

A circular knitting machine manufactured by LONATI™, S.p.A having a diameter of 3.75 inch, and 132 or 144 needles.

(3) Knitting Method

The sock-shaped upper as shown in FIG. 6 was knitted. The calcaneal portion 27 and the tiptoe portion 28 were formed of the pile knitting. The fiber reinforcement portion 30 was formed of the float stitch, and its base was the jersey stitch. Each of the fiber reinforcement portions 23, 24 and 25 was formed in a combined structure of a composite of the float stitch formed integrally with the back tuck stitch as a base; and the back tuck stitch alone. The float stitch of the fiber reinforcement portions 23, 24 and 25 were composed of 27 float loops, and the float stitch of the fiber reinforcement portion 30 was composed of 8 float loops. The weight of one sock was 25 g, and the length of the foot part was 19 cm in the stationary state. The tiptoe part having a good fit to the shape of toes was obtained by sewing a knitting end of the tiptoe part with a body (upper). An opening of the shoe was produced by folding the knit structure back, and sewing automatically with the body (upper) using a knitting machine.

(4) Production of Shoes

An upper (body), a reinforcement portion of the opening of the shoe, and a sole were prepared.

(a) Preparation

The adhesive surface side of the sole, which was to be adhered to the reinforcement portions of the upper and the opening of the shoe, was coated with a primer and dried. The primer was applied to the sole so as to improve the adhesion of the adhesive to the sole. In the same way, the adhesive surface side of the reinforcement portion of the opening of the shoe, which was to be adhered to the sole, was primer coated and dried.

(b) Adhesion of the Sole and the Reinforcement Portion of the Opening of the Shoe A water-soluble adhesive was applied to the adhesive surface of the sole (which was to be adhered to the reinforcement portion of the opening of the shoe) and the adhesive surface of the reinforcement portion of the opening of the shoe (which was to be adhered to the sole) and the sole and the reinforcement portion of the opening of the shoe were crimped.

(c) Adhesion of the Sole and the Upper

A last was inserted into the upper, a water-soluble adhesive was applied to the adhesive surface of the upper (which was to be adhered to the sole) and the adhesive surface of the sole (which was to be adhered to the upper), the adhesive was dried by heating, the upper and the sole were crimped and were dried for half a day at room temperature, dust was removed by the shoe and a shoelace was attached. Then, the shoe was cleaned and completed.

The shoe of FIG. 9 was produced as above. This shoe and a conventional shoe 10 (manufactured by MIZUNO™ Corporation) were worn respectively by five test subjects to conduct a fitting test. The fit of the shoe of the present invention was evaluated between 1 (bad) and 7 (excellent) points, on the basis of the fit of the conventional running shoe that was predetermined as 4 points. The result is shown in Table 1.

TABLE 1

| | Front foot part | Back foot part |
|---|---|---|
| Shoe of an example of the present invention | 5.4 | 4.2 |
| Conventional shoe | 4.0 | 4.0 |

The result of fitting test shows that the shoe of an example of the present invention exhibited a superior fit. The holding properties of the shoe of an example of the present invention were equivalent to those of the conventional running shoe.

Figure 10:
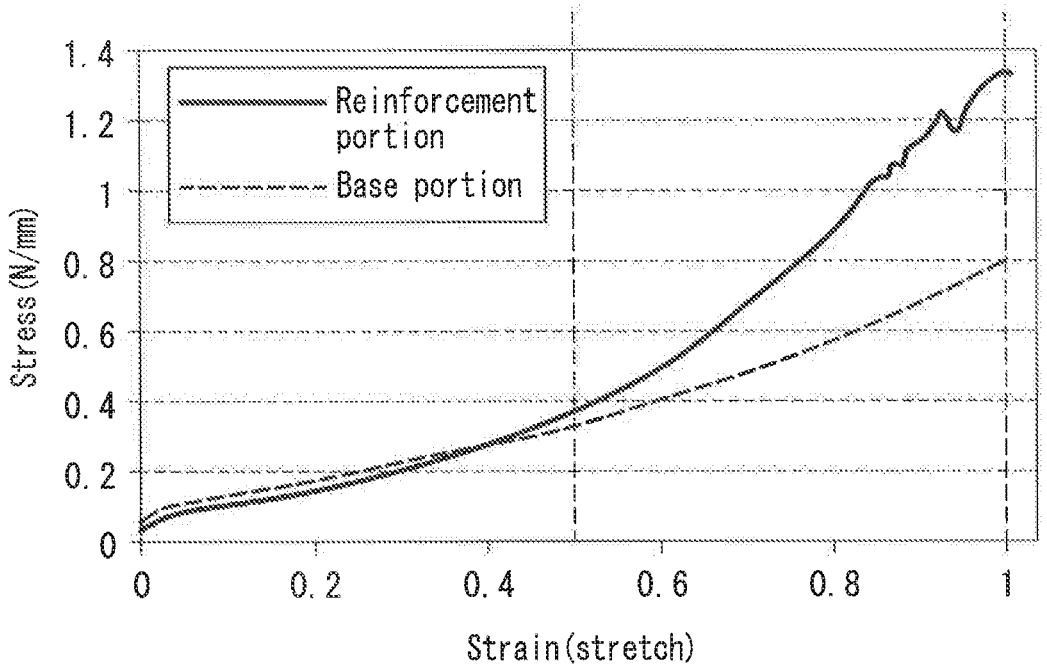
FIG. 10 is a stress-strain (stretch) graph of the fiber reinforcement portion and a base knit portion in a sock in one embodiment of the present invention.

FIG. 10 is a stress-strain (stretch) graph of the fiber reinforcement portion and the base knit portion of the sock-shaped upper of Example 1 of the present invention. The sock-shaped upper was produced with a size smaller than the foot size, whereby the upper was stretched when it was worn. The upper was stretched and a fastening stress acted on the foot when the foot was inserted into the shoe. The strain amount of the upper of FIG. 10 at this time was equivalent to 0.5 (1.5 times longer than the original length), the stress of the part with the float stitch was 0.37 N/mm, and the stress of the part without the float stitch was 0.33 N/mm. There was a small difference in stress between them. The upper during exercise stretched further than the upper in the stationary state. The graph shows that when the strain amount of the upper during exercise was more than 0.5, the difference in stress between the part with the float stitch and that of without the float stitch increased as the strain amount increased. For example, during excessive exercise (strain amount equivalent to 1 (2.0 times longer than the original length)), the difference in stress therebetween increased as the stress in the part with the float stitch was 1.34 N/mm, and that of without the float stitch was 0.80 N/mm. The result shows that the float stitch structure of the upper raised a tensile strength in accordance with the increase in the amount of the stretch and contraction of the upper. For example, when the length of the upper in a tread part (length of the circumstance of the upper excluding the sole adhesion region) was 100 mm, the length of the upper stretched to 150 mm when the shoe was worn by the user having a foot size of 27 cm. At this time, the length of the upper stretched from the original length of 100 mm to 150 mm, and the strain amount was 0.5. The upper extensively stretched when excessive movement such as a sudden turning of the direction was made. The upper stretched up to 200 mm in a case of excessive movement. At this time, the length of the upper stretched from the original length of 100 mm to 200 mm, and the strain amount increased to 1.0. As above, it was found out that using the sock of the present invention was advantageous.

INDUSTRIAL APPLICABILITY

The shoe of the present invention is suitable as various sport shoes such as marathon shoes, running shoes, and walking shoes, and also as ordinary shoes such as town shoes.

DESCRIPTION OF REFERENCE NUMERALS

1 fiber reinforcement portion
2 fiber reinforcement portion
3 fiber reinforcement portion
18 face yarn
19 back yarn
20 float stitch yarn
21 upper
23 fourth fiber reinforcement portion
24 first fiber reinforcement portion
25 second fiber reinforcement portion
30 third fiber reinforcement portion
31, 34 shoes
32 sole
33 upper material
35 reinforcement sheet
36 shoelace
41 plain stitch
42 double back yarn tuck stitch

The invention claimed is:

1. A shoe comprising a sole and an upper, wherein the upper is composed of fabric having knit structures, includes an area configured to cover a calcaneus portion of a user's foot to an area configured to cover a tiptoe portion of the user's foot, has a longitudinal axis extending from the area configured to cover the calcaneus portion to the area configured to cover the tiptoe portion, and comprises:

a base knit portion;

a first fiber reinforcement portion that is arranged in a position configured to cover a lower part of a lateral malleolus of the user's foot, a lower part of a medial malleolus of the user's foot, and an upper part of the calcaneus portion of the user's foot;

a second fiber reinforcement portion that is arranged in a position configured to cover from a first metatarsal bone of the user's foot to a fifth metatarsal bone of the user's foot; and a third fiber reinforcement portion in a bottom of the upper, extending continuously along the longitudinal axis from the first fiber reinforcement portion to the second fiber reinforcement portion, and wherein each of the first, second, and third fiber reinforcement portions comprises a float stitch including a plurality of float stitch yarns, the second fiber reinforcement defines a first gap on a medial side of the upper and a second gap on a lateral side of the upper, the second fiber reinforcement portion converging respectively to close each of the first gap and the second gap on a top of the upper;

the first gap is positioned such that the second fiber reinforcement portion is configured to avoid an area of a head part of the first metatarsal bone when in use, the second gap is positioned such that the second fiber reinforcement portion is configured to avoid an area of a head part of the fifth metatarsal bone when in use, the area configured to cover the tiptoe portion is a base knit material, the area configured to cover the calcaneus portion is the base knit material, and the base knit material has a knit structure different from a knit structure of the first, second, and third fiber reinforcement portions.

2. The shoe according to claim 1, wherein, when a strain ratio (stretch ratio) of a portion of the float stitch in a float stitch yarn direction is 1 (two times the length before measurement), a stress in the portion of the float stitch of any of the first fiber reinforcement portion and the second fiber reinforcement portion is 1.2 times or more greater than a stress in a portion of the base knit portion.

3. The shoe according to claim 1, wherein the upper has a sock shape composed of the fabric having the knit structures, and the bottom of the upper is fixed to the sole without changing the sock shape.

4. The shoe according to claim 1, further comprising a fourth fiber reinforcement portion that is arranged in a position configured to cover at least one part of each of cuneiform bones of the user's foot, a cuboid bone of the user's foot, and a navicular bone of the user's foot.

5. The shoe according to claim 4, wherein the first fiber reinforcement portion and the fourth fiber reinforcement portion are joined to one another.

* * * * *